US005435372A

United States Patent [19]

Kikuchi

[11] Patent Number: 5,435,372

[45] Date of Patent: Jul. 25, 1995

[54] SMOOTH OPENING/CLOSING MULTIPLE PANEL FOLDING SPRING, OR THE LIKE, BIASED FOLDING DOORS

[75] Inventor: Hiroaki Kikuchi, Tokyo, Japan

[73] Assignee: Jamco Corporation, Tokyo, Japan

[21] Appl. No.: 150,817

[22] Filed: Nov. 12, 1993

[30] Foreign Application Priority Data

Jun. 23, 1993 [JP] Japan ..... 5-151841

[51] Int. Cl.[6] ..... E05D 15/26

[52] U.S. Cl. ..... 160/206

[58] Field of Search ..... 160/206, 196.1, 199, 160/188, 113, 118, 119; 16/51, 66, 82, 84, 90

[56] References Cited

U.S. PATENT DOCUMENTS 3,385,344 5/1968 Andrews ..... 160/206
3,494,408 2/1970 D'Ercole ..... 160/206
3,987,837 10/1976 Hewson ..... 160/206
4,064,590 12/1977 Smith ..... 160/206 X

*Primary Examiner*—David M. Purol
*Attorney, Agent, or Firm*—Armstrong, Westerman, Hattori, McLeland & Naughton

[57] ABSTRACT

The folding doors 100 includes of a first door panel 150 and a second door panel 110, the first door panel 150 being attached to the door opening portion of the wall rotatively by a pin 150. The second door panel 110 is attached to the first door panel 150 by a hinge 4. A guiding device 120 is mounted on the upper portion of the second door panel 110. The guiding device 120 holds a slider 122 and a rotary damper 200 for damping the rotation of the axis holding the slider. The slider 122 slides without rotating inside the guiding rail mounted on the upper portion of the door opening portion. The second door panel 110 rotates by opening/closing action, so by damping this relative rotation with the rotary damper 200, the folding doors could be closed quietly.

4 Claims, 15 Drawing Sheets

SMOOTH OPENING/CLOSING MULTIPLE PANEL FOLDING SPRING, OR THE LIKE, BIASED FOLDING DOORS

BACKGROUND OF THE INVENTION

1. Field of the Invention

The present invention relates to folding doors used, for example, as the door of a lavatory in an airplane.

2. Description of the Prior Art

Folding doors do not use up as much space, when opening and closing, as compared to normal board-type doors accordingly, they are normally utilized in the lavatory of airplanes, telephone boxes, bath units of houses, and the like.

FIG. 14 is a view showing folding doors used in lavatory units of airplanes.

The folding doors 1 comprise of a first door panel 2 and a second door panel 3, and the first door panel 2 and the second door panel 3 is connected by a hinge 4.

FIG. 15 is a cross sectional view showing the hinge 4. The hinge includes having a structure hinge members 4A, 4B, forming a gear portion, set on the end portions of the door panels 2, 3, and both hinge members are held by a cover member 4D.

By the engagement of the gear portion of hinge members 4A, 4B, the two door panels 2, 3 fold smoothly, and the sealing ability is improved because the hinge members are held by the cover 4D.

A coil spring 5 (FIG. 16) is set in the hinge portion, and forces the door panels 2, 3 to be parallel, i.e. forming a plane surface (to be closed) basically.

FIG. 16 shows the detail of the coil spring 5. As noted, the coil spring 5 is positioned between the first door panel 2 and the second door panel 3 and it forces the folded panels 2, 3 in the direction to return to a position forming a plane surface.

A door locking device 8 (FIG. 14) is set on the second door panel 3. A pin 6 is mounted on each of the upper and lower end portions of the first door panel 2, and the pins support the folding doors 1 rotatably on the side of the wall of the lavatory unit.

A guiding device 7 (FIGS. 19 and 17) is set on the upper portion of the second door panel 3, and it enables the second door panel 3 to open and close along the door opening portion of the lavatory unit.

FIG. 17 shows the details of the guiding device 7. The guiding device 7 set on the upper portion of the second door panel 3 includes a slider 7A and a shaft 7B which supports the slider VA. The slider 7A, for example, has a quadrilateral plane form, and fits in the guide rail 9 formed on the door opening portion.

When the second door panel 3 opens or closes, the slider 7A guides the second door panel smoothly by sliding through the guide rail 9.

When the plane form of the slider 7A is a quadrilateral, the slider 7A moves along a straight line and the door panel 3 moves in a gyrating manner so the slider 7A rotates against the shaft 7B.

OBJECT OF THE INVENTION

In folding doors having the above mentioned structure, the spring modulus of the coil spring 5 needs to be increased in order to improve the sealing ability of the door.

When the spring modulus of the coil spring 5 is increased, the folded door panels 2, 3 rapidly return to a plane form, making a bumping noise.

The lavatory units of airplanes especially are placed near passenger seats, and many people use the unit while other passengers are asleep. Therefore, it is necessary to prevent the bumping noise that the folding doors make when being shut.

The present invention aims at offering folding doors that can be opened and closed smoothly, and at the same time preventing the bumping noise that the door makes when being shut.

SUMMARY OF THE INVENTION

The folding doors of the present invention comprises a guiding rail provided on the door opening portion, a slider mounted on the second door panel by a rotation axis and which slides inside the guiding rail, and a rotary damper which dampens the rotating power of the rotation axis.

The folding doors have a forcing means on the connecting portion of the first door panel and the second door panel to restore the first door panel and the second door panel to a plane state.

DETAILED DESCRIPTION OF THE PREFERRED EMBODIMENT

Figure 1:
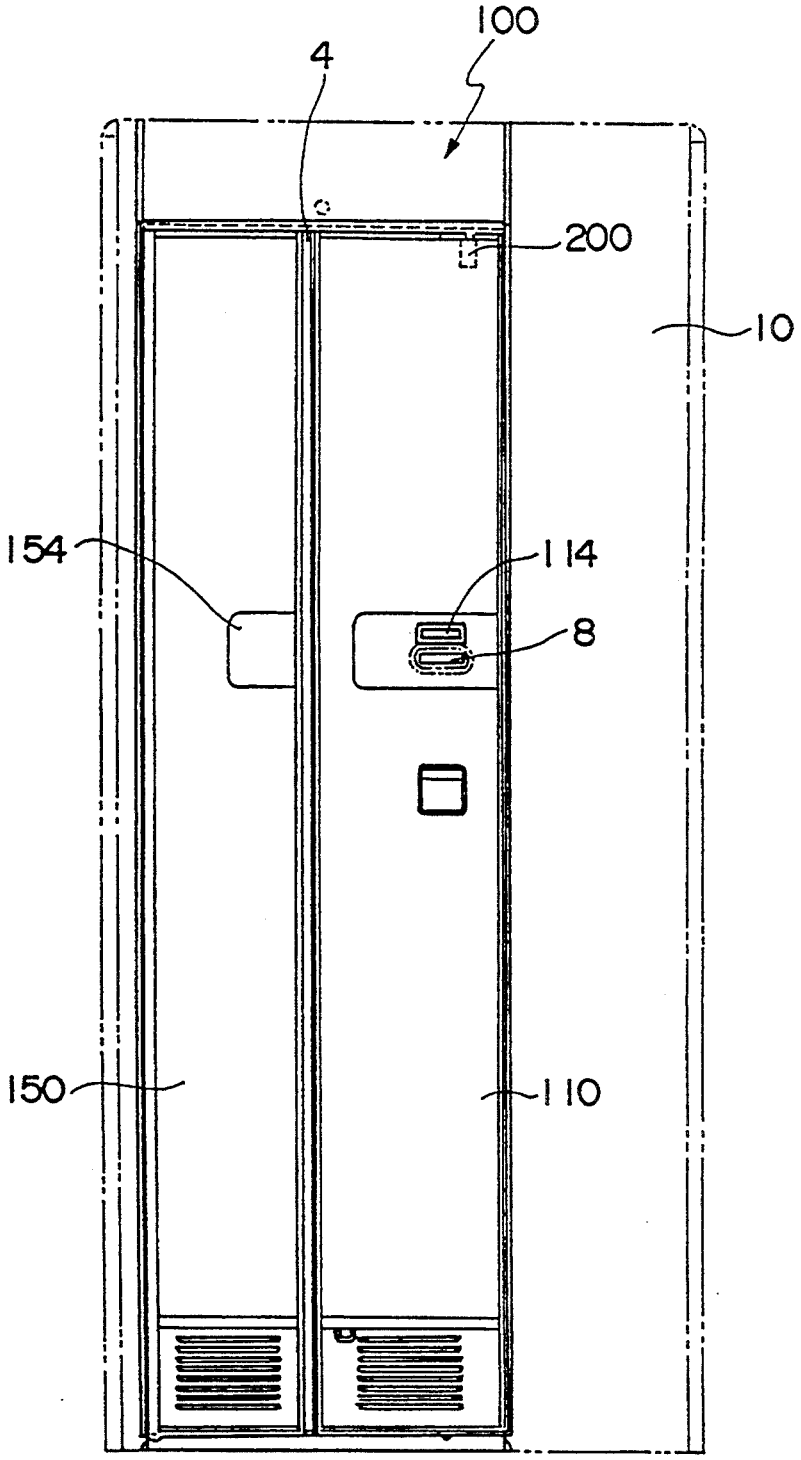
FIG. 1 is a front view showing the embodiment of the present invention.
Figure 2:
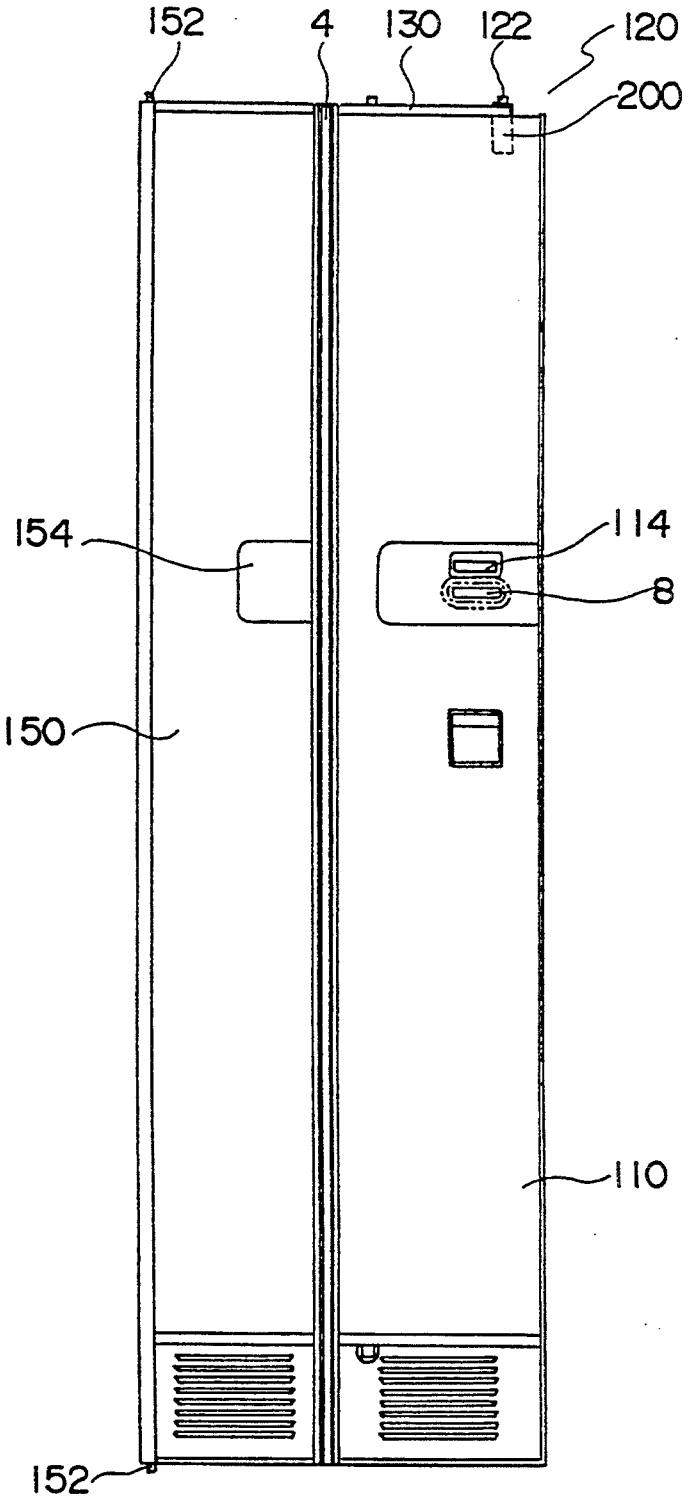
FIG. 2 is a front view of the folding doors.

FIG. 1 is a front view showing the embodiment of the present invention, and FIG. 2 is a front view of the folding doors. The folding doors, referred to by the number 100, are set on the opening portion of the front wall 10 of lavatory units, or the like.

Figure 15:
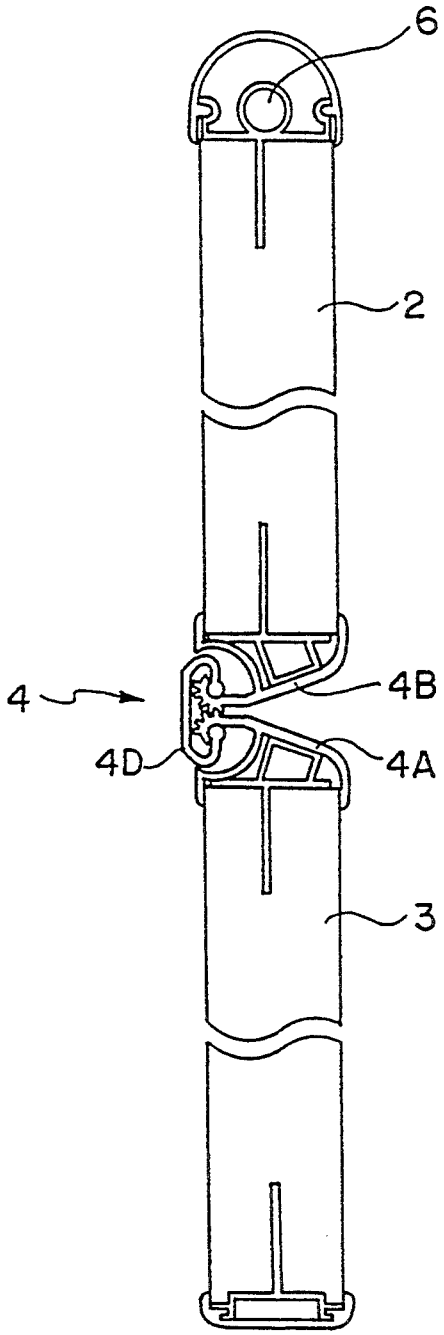
FIG. 15 PRIOR ART
FIG. 15 is a cross sectional view of the hinge.
Figure 16:
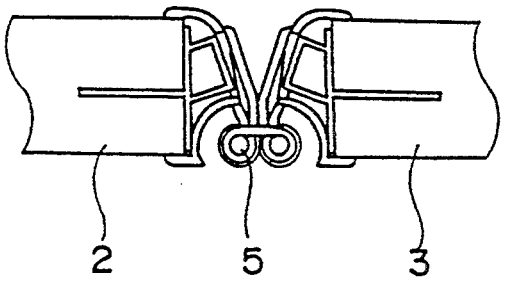
FIG. 16 PRIOR ART
FIG. 16 is a diagram of the coil spring.
Figure 17:
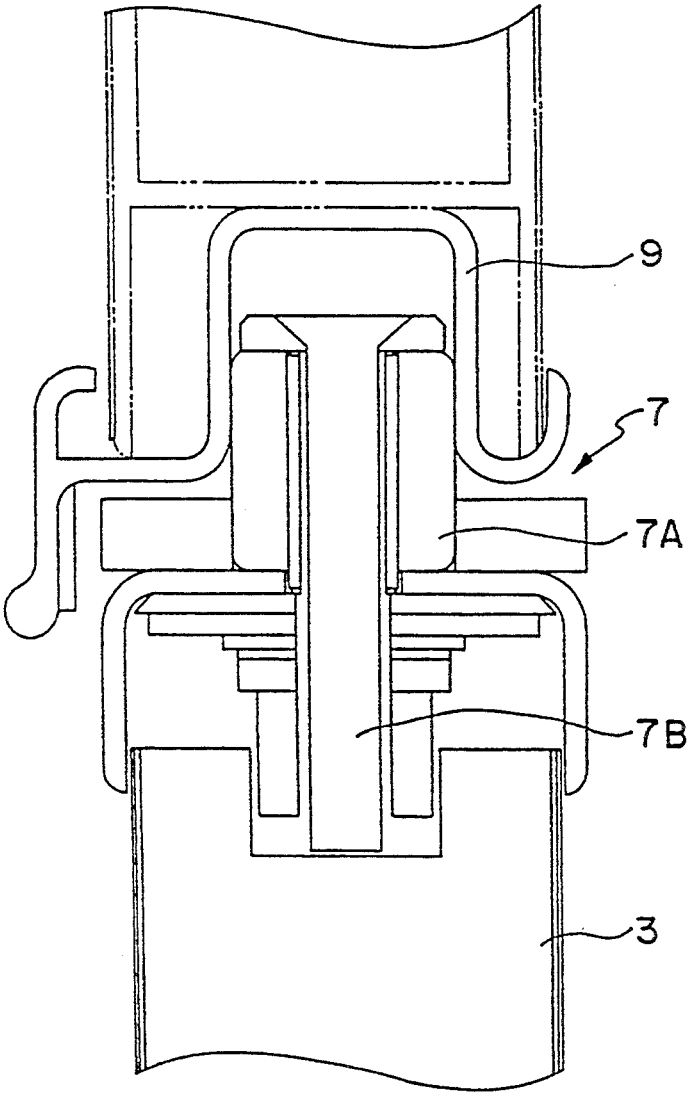
FIG. 17 PRIOR ART
FIG. 17 is a view of the guiding device.

The folding doors 100 have a first door panel 150 and a second door panel 110, and the first door panel 150 and the second door panel 110 are connected by a hinge 4 as shown in FIG. 15 and a coil spring 5 as shown in FIG. 16.

A pin 152 is mounted on the upper and lower end portions of the first door panel 150, and the folding doors 100 can be rotatably supported by inserting the pins 152 to hole provided on the opening portion of the wall 10.

An indicating window 114 shows the occupied/vacancy condition of the lavatory. When the user enters the unit, allows the door to close and operates the knob 8, mounted on the inside of the second door panel 110, the second door panel 110 can be fastened to the wall 10, and the indicating window 114 will indicate that the lavatory is occupied.

A push board 154 (FIG. 2) is mounted on front of the first door panel 150 near the hinge 4. When the user pushes the push board 154, the fold doors 100 folds inwardly at the hinge 4, and the door is thus opened. When the pushing force is removed, the folding doors 100 close automatically by the restoring power of the coil spring mounted on the inner side of hinge 4.

In lavatory units of airplanes and the like, the panel material is often a honeycomb structure to reduce weight thereof. The first door panel 150 and the second door panel 110 of the folding doors 100 also can be a honeycomb board structure. Therefore, the surrounding surfaces of the door panel are covered with covers. A fixing board 130, serving also as a cover, is fixed on the upper portion of the second door panel 10, and a slider 120 and a rotary damper 200 is installed on the fixing board 130.

Figure 3:
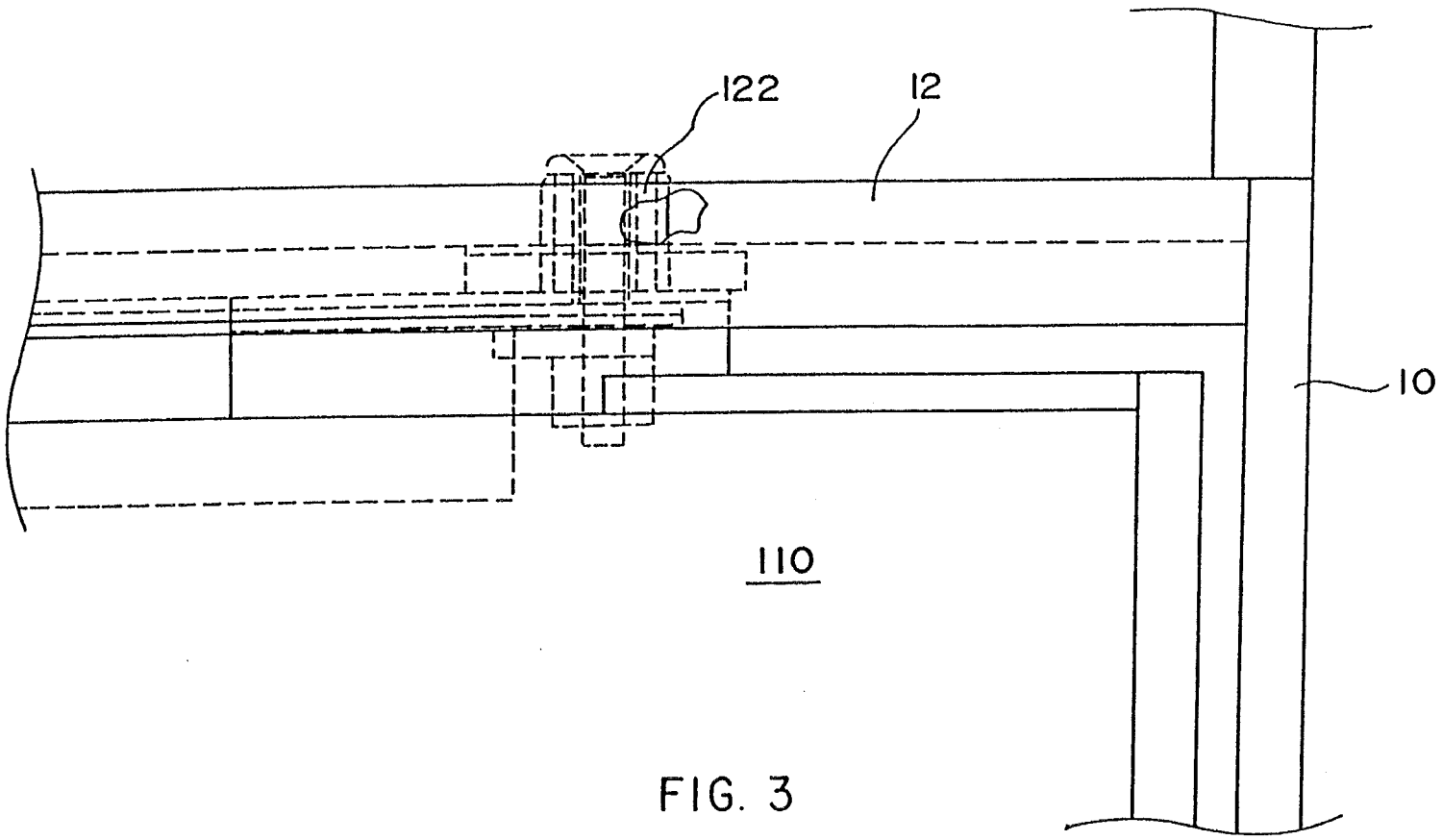
FIG. 3 is a diagram showing the guiding structure of the folding doors.

FIG. 3 shows the joint condition in which the wall 10 and the second door panel 110 are joined, and, as shown, the slider 122, mounted on the upper portion of the second door panel 110, is inserted to a guide rail 12 mounted on the upper portion of the opening portion of the wall 10.

Figure 4A:
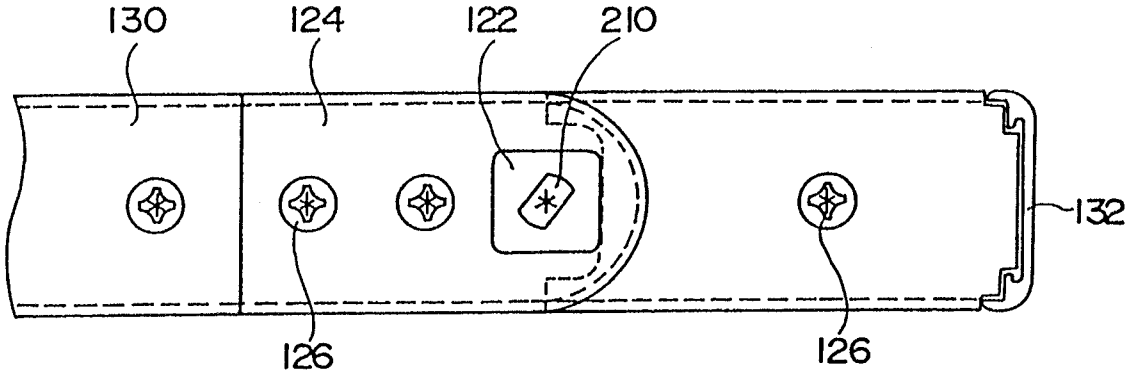
FIG. 4 is a view of the guiding device.
Figure 4B:
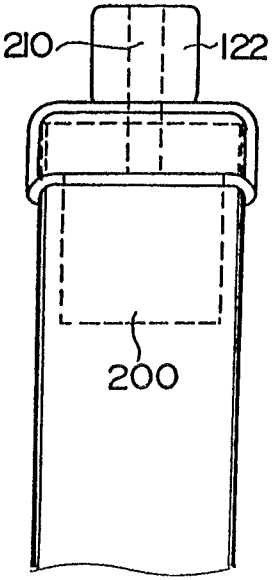
Figure 4C:
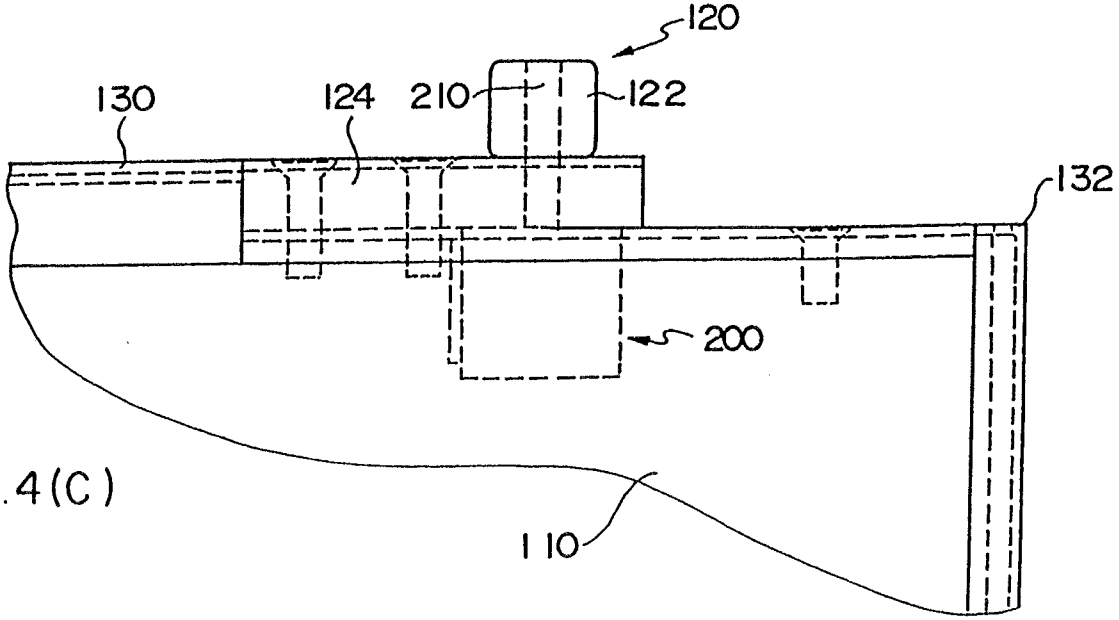
Figure 5A:
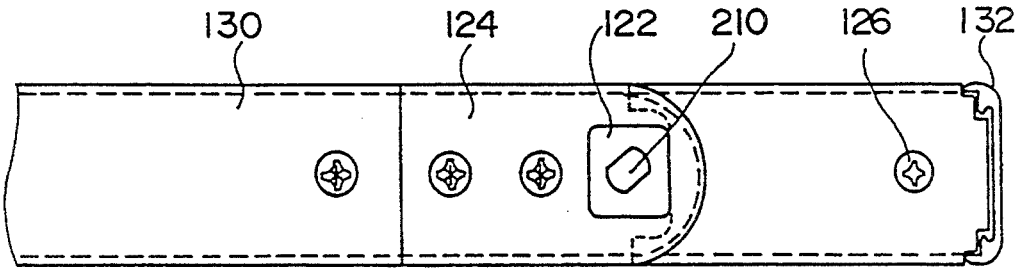
FIG. 5 is a component diagram of the guiding device.
Figure 5B:
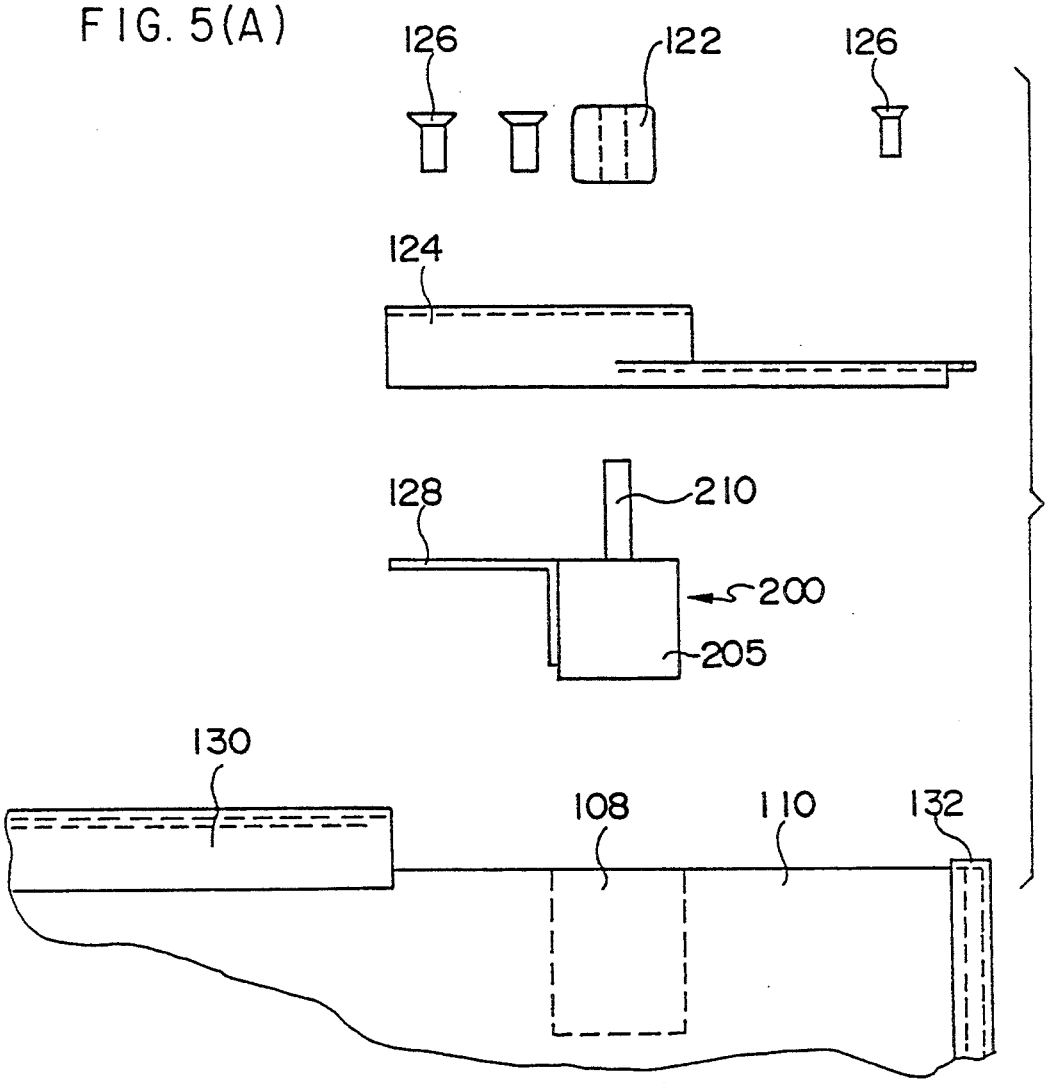

FIG. 4 is a view of a guiding device equipped on the folding doors of the present invention, and FIG. 5 is a component diagram of the guiding device.

The guiding device referred to by the number 120, comprises a fixing board 124 fixed on the upper portion of the second door panel 110, a rotary damper 200 fixed on the lower portion of the fixing board 124, and a slider 122 fixed on a shaft 210 of the rotary damper 200.

An upper cover 130 is mounted on the upper portion of the second door panel 110, and a side cover 132 is mounted on the side portion. The fixing board 124 of the guiding device 120 could also serve as the upper cover 130, but such as shown they could also have a different structure.

A casing 20S of the rotary damper 200 is attached on the lower surface of the fixing board 124 by an attaching fixture 128, and is fixed onto the upper portion of the second door panel 110 by a screw 128. A hole 108 for inserting the casing 208 of the rotary damper 200 is provided on the upper portion of the second door panel 110.

The shaft 210 of the rotary damper 200 goes through the hole formed on the fixing board 124 and extends to the upper direction. The slider 122 is mounted on the shaft 210.

The slider 122 has a quadrilateral plane form and is fixed so as not to rotate against the shaft 210. The slider 122 moves linearly through the guide rail 12 of the wall without rotating.

Figure 6:
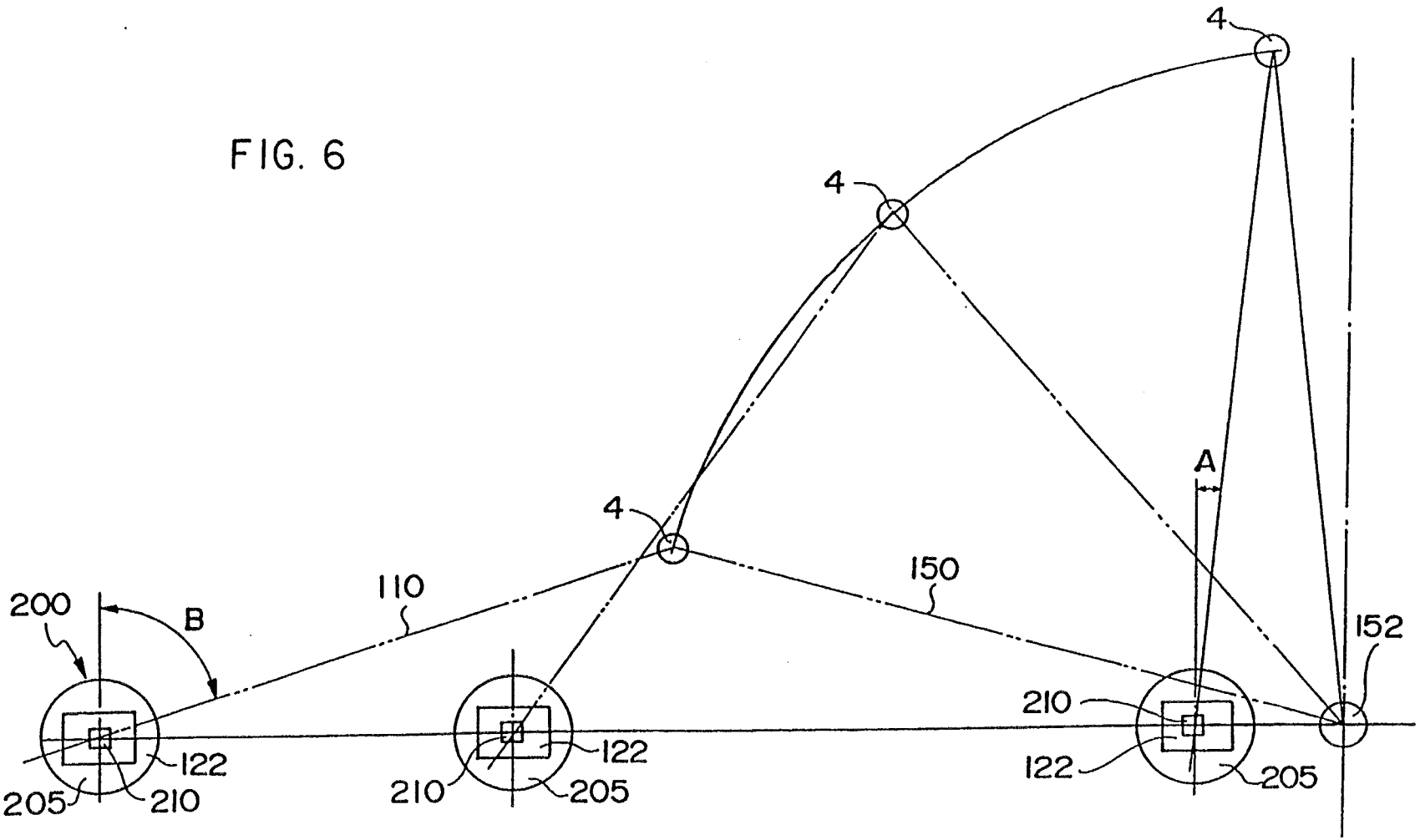
FIG. 6 is a diagram showing the locus of the opening and closing of the folding doors.

FIG. 6 shows the locus of the slider 122 and the rotary damper 200 when the folding doors is opened and closed.

When the first door panel 150 and the second door panel 110 is folded inwardly with the hinge 4 in the center, the slider 122 moves linearly toward the fixing pin 152 of the first door panel 150.

The slider 122 will not rotate, but the case 205 fixed on the side of the second door panel 110 pivotes as the door panel 110 opens, so the angle formed by the shaft 210 and the casing 205 of the rotary damper 200 ranges from angle B to angle A.

When the user lets go of the folding doors, the second door panel 110 and the first door panel 150 move so as to return to the plane form by the restoring power of the coil spring mounted on the hinge 4 portion. By this movement, the angle formed by the shaft 210 and the casing 205 relatively rotates from angle A to angle B.

Therefore, by operating a damping force between the casing 205 and the shaft 210 of the rotary damper 200, the folding doors can be smoothly and quietly closed.

Figure 7:
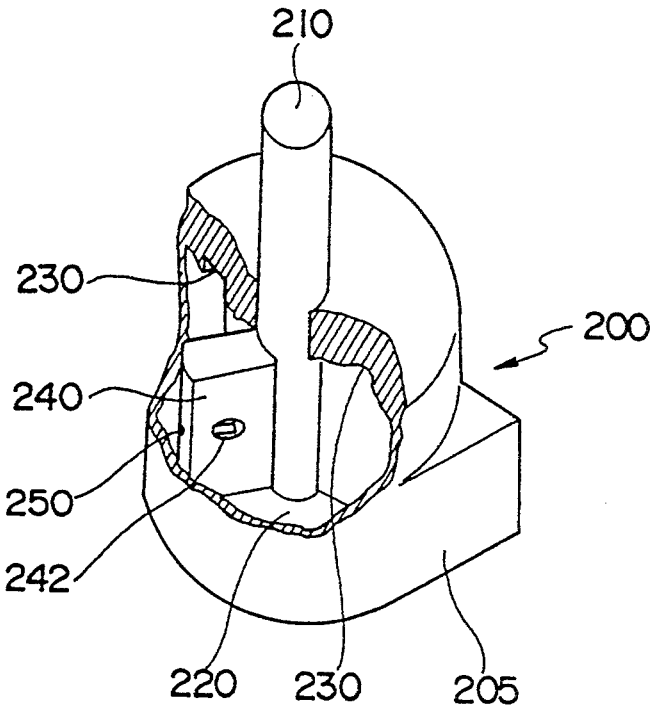
FIG. 7 is a schematic view of a rotary damper.
Figure 8:
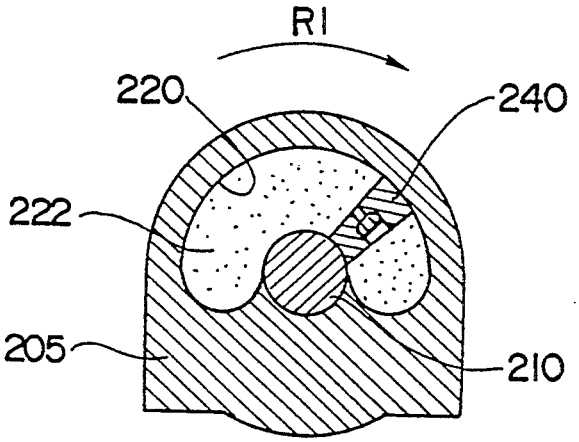
FIG. 8 is a cross sectional view of the rotary damper.
Figure 9:
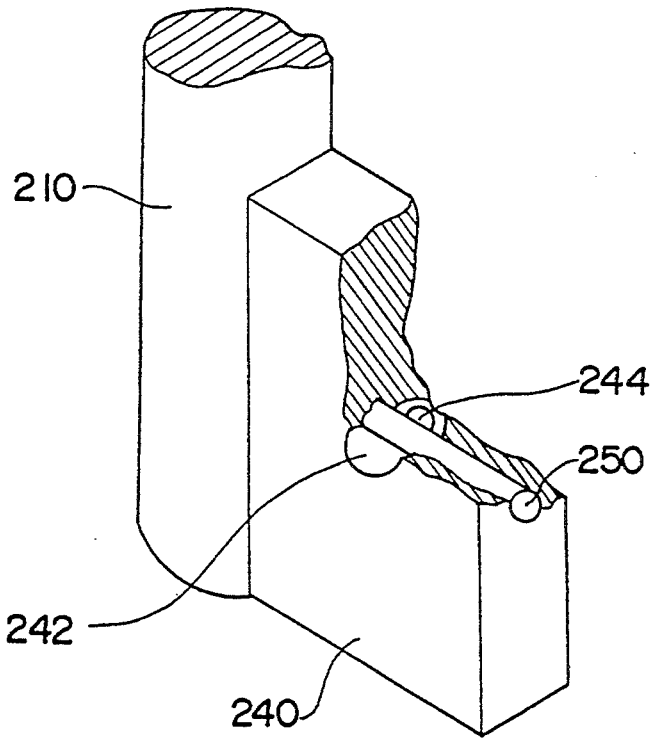
FIG. 9 is a cross sectional view of a rotor.

FIG. 7 is a perspective view of the rotary damper 200, FIG. 8 is a cross sectional view thereof and FIG. 9 is a cross sectional view of a rotor.

The rotary damper, generally shown as reference 200, includes a casing 205, a damping chamber 220 formed in the casing 205 and a shaft 210 extending through the case 205 for relative rotation. A rotor 240 is mounted on the shaft 210 for slidable rotation in the damping chamber 220. The damping chamber 220 is filled with a silicone oil 222 to produce a resistance against rotation of the rotor 240.

The rotor 240 has a tapered hole 242 which contains a ball 244. A pin 250 extends through the rotor 240 across the tapered hole 242 to hold the ball 244 in a portion of the tapered hole 242 having a smaller diameter.

In the side wall of the damping chamber 220 is provided an orifice groove 230 which is configured to reduce the cross sectional area of the silicone oil flow path defined between the side wall of the damping chamber 220 and the lateral portion of the rotor 240 to put a brake force to the rotating motion of the rotor 240.

Figure 10:
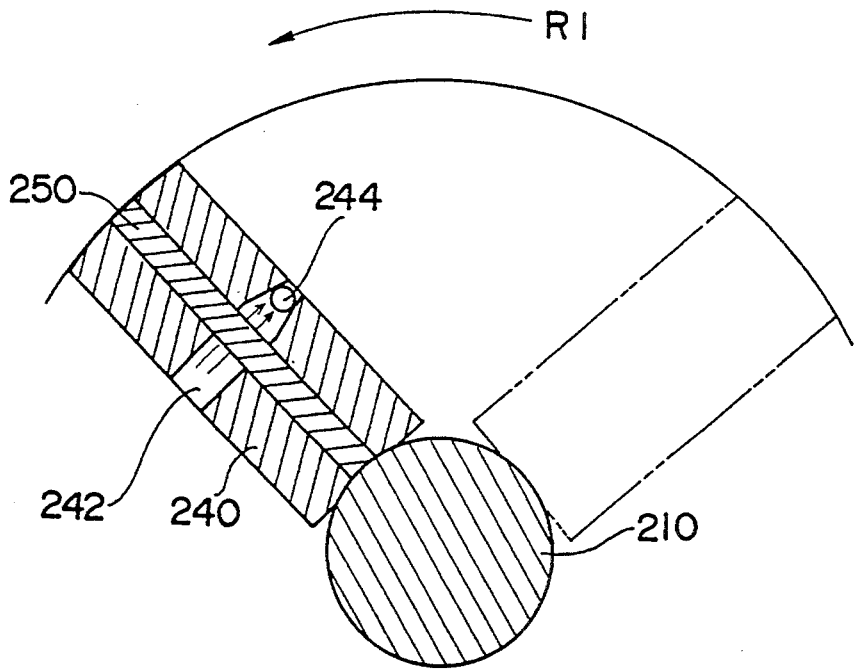
FIG. 10 is a diagram illustrating the damping operation of the rotor.
Figure 11:
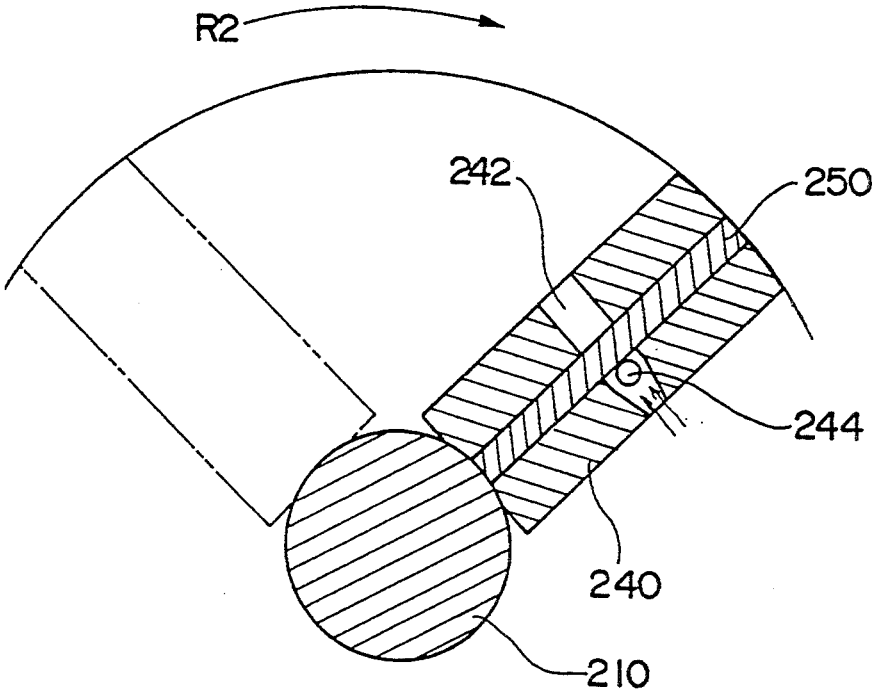
FIG. 11 is a diagram illustrating the damping operation of the rotor.
Figure 12:
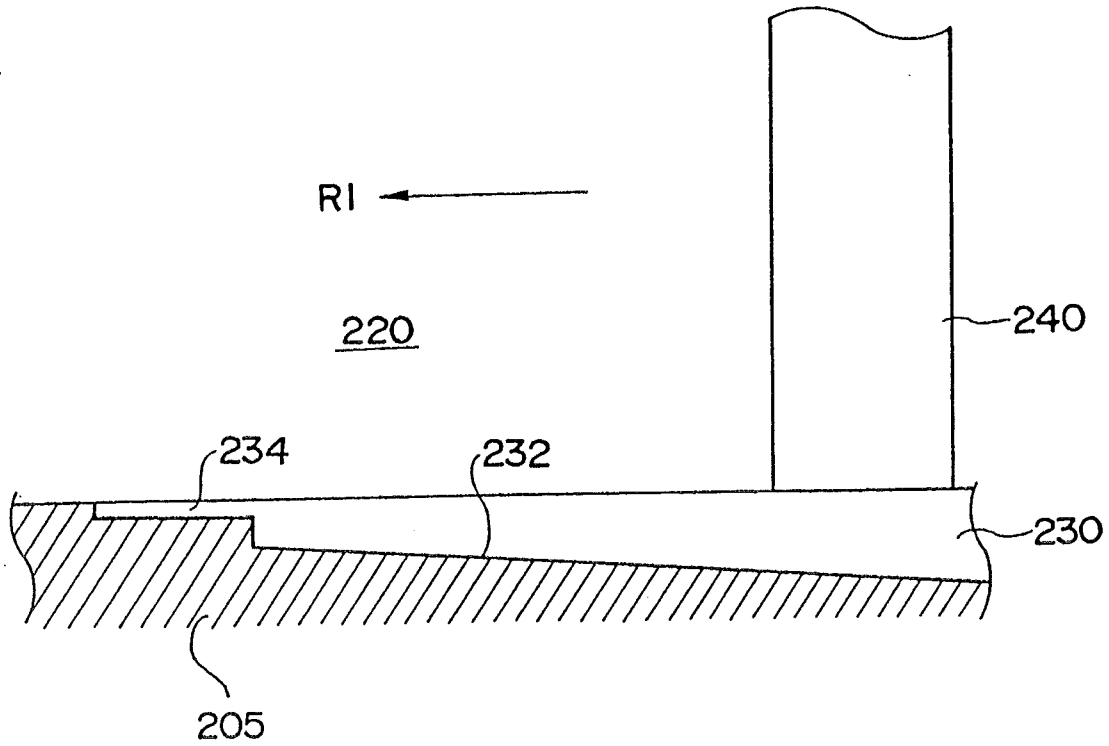
FIG. 12 is a cross sectional view of an orifice groove.

FIG. 10 and FIG. 11 are views showing the rotating directions and a damping function of the rotor 240. FIG. 12 is a view showing the shape of the orifice 230.

With reference to FIG. 10, when the shaft 210 and the rotor 240 rotate in the damping chamber 220 in the direction shown by arrow R1, silicone oil passing through the tapered hole 242 brings the ball 244 to the smaller diameter portion so as to shut the tapered hole 242 with the ball 244. Then, the silicone oil pressurized by the rotor 240 can flow to the back side of the rotor 240 only through the orifice groove 230. Therefore, by designing the orifice groove 230 to vary in effective cross sectional area in response to the rotating angle of the rotor 240, the damping force (braking force to the rotor) can be adjusted in response to the rotational position of the rotor 240.

As shown in FIG. 11, when the rotor 240 rotates in the direction shown by arrow R2, the flow of the silicone oil pushes the ball 244 back to the position of the pin 250. As a result, the tapered hole 242 is opened and permits the silicone oil to flow through both the tapered hole 242 and the orifice groove 230. Therefore, the resistance applied to the rotor 240 is reduced.

The orifice groove 230, as shown in FIG. 12, may have a tapered bottom surface 232 to continuously increase the resistance to the rotor 240 and to maximize the resistance at an end of the orifice groove 280 where the depth of the bottom surface 234 is smallest to minimize the cross sectional area of the groove and maximize the resistance to the rotor 240.

If a user attempts to close the door by force, the door and the damper can receive an excessive load.

Figure 13:
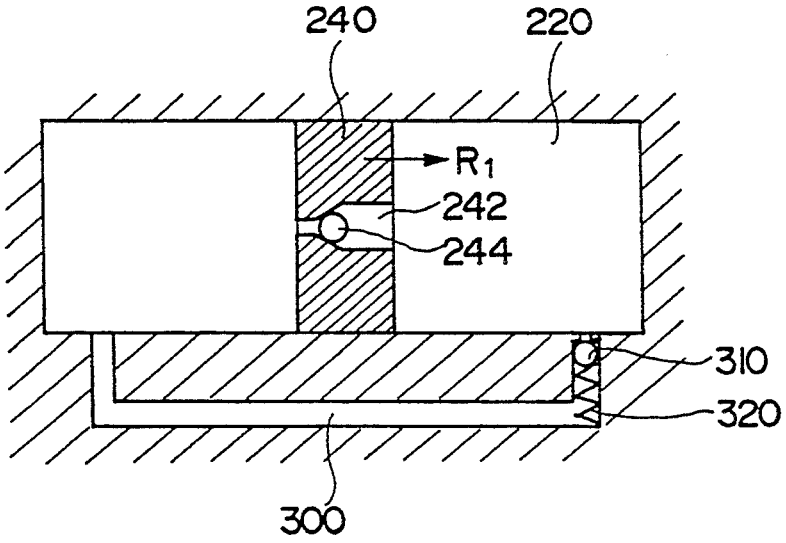
FIG. 13 is a diagram of a pressure adjusting valve.
Figure 14:
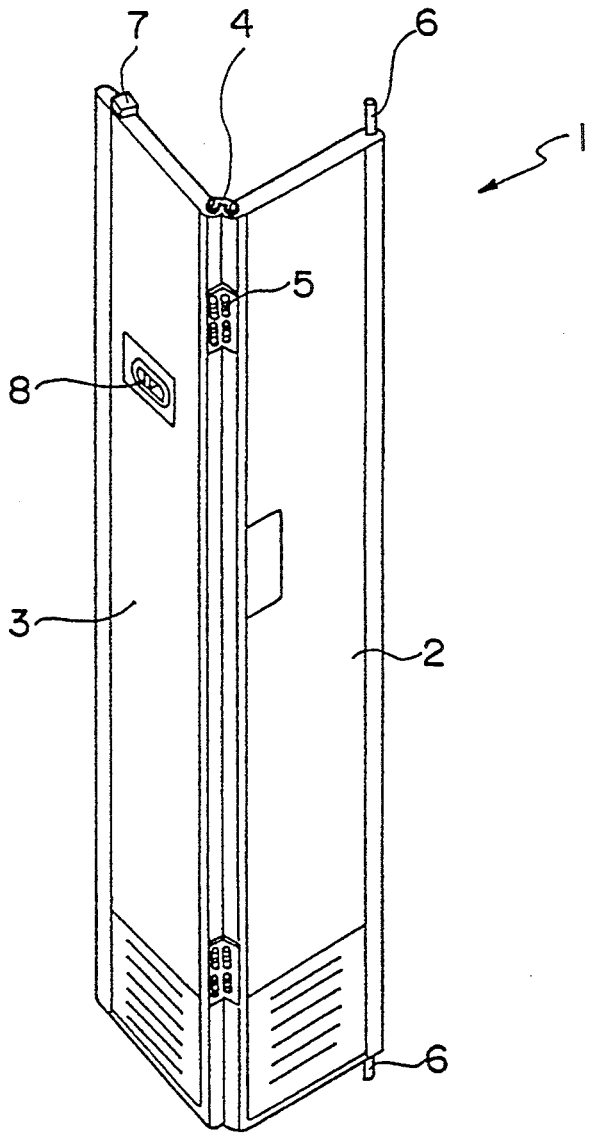
FIG. 14 PRIOR ART
FIG. 14 is a schematic view of the folding doors used in lavatory units.

FIG. 13 shows a pressure adjusting valve for releasing such an excessive load. When the rotor 240 moves in the arrow R1 direction in the damping chamber 220, the ball 244 shuts the tapered hole 244 and produced a damping force. When a user tries to close the door with force, the pressure in the silicone oil in the damping chamber 220 will increase too much. In order to adjust the extraordinary pressure in the silicone oil, a bypass 300 is provided to communicate opposite sides of the damping chamber 220, and a check valve comprising a ball 310 and a spring 320 is provided in the bypass 300.

When the pressure in the damping chamber 220 exceeds a predetermined value, the check valve is opened to discharge the excessive pressure.

As described above, the folding doors of the invention has a rotary damper mounted on the door panel guided by rails, so that the door which is closed by a spring force receives a damping force, and it closes smoothly. Therefore, occurrence of a banging noise, etc., can be prevented.

Because a damper is mounted, the spring force can be reinforced, if necessary, in order to gain the ability of having a door having high density.

What is claimed is:

1. A folding doors assembly, comprising:

a first door panel rotatably supportable at one side portion of a door opening;

a second door panel;

a hinge foldably connecting said first door panel to said second door panel; and a guiding device which guides the second door panel along the door opening;

wherein the guiding device includes:

a guiding rail fixable on the door opening;

a slider rotatably mounted on said second door panel and slidable inside said guiding rail; and a rotary damper operatively connected to said slider to dampen the rotational movement between said slider and said second door.

2. The folding doors assembly claimed in claim 1 further including a forcing means for forcing the first door panel and the second door panel towards a plane state.

3. The folding doors assembly claimed in claim 1 wherein the rotary damper includes:

a case having a damping chamber formed inside the case;

liquid filled inside said damping chamber;

a shaft extending into said case and into said damping chamber;

a rotor connected to said shaft and slidably rotatable inside said damping chamber;

a check valve mounted on said rotor; and an orifice groove mounted on a side wall of said damping chamber.

4. The folding doors assembly as claimed in claim 3 wherein the orifice groove is formed convergingly so that the damping power increases as the first door panel and the second door panel moves toward a plane state.

* * * * *